US008354911B2

(12) United States Patent
Visser et al.

(10) Patent No.: US 8,354,911 B2
(45) Date of Patent: Jan. 15, 2013

(54) SEGMENTED CORE TRANSFORMER

(75) Inventors: Barend Visser, Potchefstroom (ZA); Petrus Paulus Kruger, Potchefstroom (ZA)

(73) Assignee: North-West University, Potchefstroom (ZA)

( * ) Notice: Subject to any disclaimer, the term of this patent is extended or adjusted under 35 U.S.C. 154(b) by 0 days.

(21) Appl. No.: 13/377,728

(22) PCT Filed: Jun. 15, 2010

(86) PCT No.: PCT/IB2010/052679

§ 371 (c)(1),
(2), (4) Date: Feb. 10, 2012

(87) PCT Pub. No.: WO2010/146538

PCT Pub. Date: Dec. 23, 2010

(65) Prior Publication Data

US 2012/0133475 A1 May 31, 2012

(30) Foreign Application Priority Data

Jun. 15, 2009 (ZA) ..... 2009/04173

(51) Int. Cl.
*H01F 27/24* (2006.01)
*H01F 27/02* (2006.01)
*H01F 38/12* (2006.01)

(52) U.S. Cl. ..... 336/212; 336/90; 123/634; 123/635

(58) Field of Classification Search ..... 336/90, 336/212; 123/634, 635
See application file for complete search history.

(56) References Cited

U.S. PATENT DOCUMENTS

| | | | | |
|---|---|---|---|---|
| 5,128,646 | A | 7/1992 | Suzuki et al. | |
| 6,025,770 | A * | 2/2000 | Okamoto et al. | 336/83 |
| 6,198,761 | B1 | 3/2001 | Von Bergmann et al. | |
| 7,098,765 | B2 * | 8/2006 | Fujiyama et al. | 336/90 |
| 7,487,767 | B2 * | 2/2009 | Shimada et al. | 123/634 |
| 2005/0110604 | A1 | 5/2005 | Fujiyama et al. | |
| 2006/0091989 | A1 | 5/2006 | Vinciarelli et al. | |
| 2006/0214758 | A1 | 9/2006 | Wada | |
| 2008/0157914 | A1 | 7/2008 | Pokharna et al. | |
| 2009/0085701 | A1 * | 4/2009 | Veneruso et al. | 336/92 |

FOREIGN PATENT DOCUMENTS

DE 12 45 487 7/1967

(Continued)

OTHER PUBLICATIONS

International Search Report for PCT/IB2010/052679, mailed Oct. 6, 2010.

International Preliminary Report on Patentability for PCT/IB2010/052679, with four (4) Amended Sheets, mailed Aug. 18, 2011.

*Primary Examiner* — Mohamad Musleh
*Assistant Examiner* — Tsz Chan
(74) *Attorney, Agent, or Firm* — Nixon & Vanderhye PC

(57) ABSTRACT

The transformer (10) comprises a core (12), a primary winding (14) and a secondary winding 16. The core comprises an elongate limb (13) having a main axis (15) and comprising a plurality of segments (12.1 to **12.*n*) of a magnetic material and gaps (18.1 to 18.*n*−1) between segments arranged in alternating relationship along the main axis (15). The main axis (15) is parallel to a direction of a magnetic field in the limb (13). Each gap has a linear segment separating extent (gj which is parallel to the main axis (15). The value of n is larger than three and the gaps are filled with an isolation medium (20**).

16 Claims, 1 Drawing Sheet

FOREIGN PATENT DOCUMENTS

Figure 1:
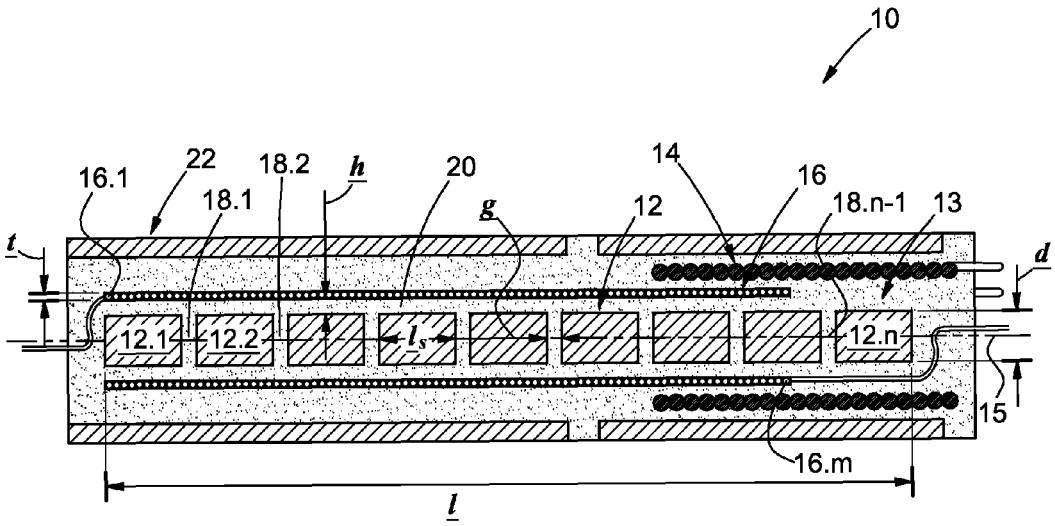

| | | |
|---|---|---|
| DE | 10 2006 026466 | 12/2007 |
| GB | 1 571 057 | 7/1980 |
| GB | 2 037 089 | 7/1980 |
| WO | WO 2007/135584 | 11/2007 |

* cited by examiner

SEGMENTED CORE TRANSFORMER

This application is the U.S. national phase, under 35 U.S.C. §371, of International Application No. PCT/IB2010/052679, filed 15 Jun. 2010, which claims priority to South Africa Application No. 2009/04173, filed 15 Jun. 2009, the entire contents of each of which are hereby incorporated herein by reference.

INTRODUCTION AND BACKGROUND

This invention relates to transformers, a core for a transformer and an ignition system for a vehicle comprising a transformer.

A known vehicle ignition system transformer comprises a unitary solid or laminated core, such as a pencil core, of a magnetic material. Primary and secondary windings of the transformer are wound around the core. The transformer must comply with a number of requirements. The solid core must provide good magnetic coupling between the primary and secondary windings, so that energy can be transferred from the primary winding to the secondary winding during a single pulse. The primary and secondary inductances must be large enough so that sufficient energy can be stored in the magnetic core, so that the maximum primary current is not too high and so that the spark duration is long enough for a stable spark. The large secondary inductance requires a large number of turns. This results in the secondary winding having a resistance of several kilo-ohm. The resistance results in heating of the windings, which must be taken away. Hence, the transformer must provide for sufficient heat transfer from the windings to the outside of the transformer. The magnetic design must be such as to prevent core saturation during high voltage generation. Furthermore, enough magnetic material is required to store sufficient energy in the magnetic field. Very good electrical isolation is required between the secondary windings and the magnetic core. The maximum secondary voltage is normally larger than 30 kV and the magnetic core is normally conductive. The isolation between the core and windings must be able to withstand the maximum voltage. Sufficient isolation between the windings is also required. Because most magnetic materials meeting these requirements are conductive or have a low dielectric strength, a relatively thick isolation layer is required between the core and the secondary winding, which is undesirable. A transformer suitable for use in an automobile engine must be able to operate at temperature between about −40° C. and about +140° C. Due to different thermal expansion coefficients between the core and the isolation material, mechanical stresses develop. After a number of thermal cycles, gaps or cracks between the magnetic material and isolation material may develop, which may be fatal.

To achieve these requirements while also reducing the volume of the transformer becomes very difficult. Because of the large number of turns in a small volume, the capacitance of the winding (including inter-turn capacitance) becomes large, which results in more energy required to generate a certain high voltage.

OBJECT OF THE INVENTION

Accordingly, it is an object of the present invention to provide an alternative transformer, core therefor and ignition system, with which the applicant believes the aforementioned disadvantages may at least be alleviated or which may provide useful alternatives for the known transformers, cores and ignition systems.

SUMMARY OF THE INVENTION

According to the invention there is provided a transformer comprising a core, a primary winding and a secondary winding, the core comprising an elongate limb having a main axis, a plurality (n) of segments of a magnetic material and gaps between segments arranged in alternating relationship along the main axis, each gap having a linear segment separating extent which is parallel to the main axis, n being larger than 3 and the gaps being filled with an isolation medium.

Each segment may comprise a cylindrical body having a main axis and comprising a side wall extending between opposed first and second end walls. The gap between first and second adjacent segments may extend between the second end wall of the first segment and the first end wall of the second segment. The main axes of the segments may be aligned with the main axis of the limb. At least respective centre regions of the first and second end walls of a segment may extend parallel to one another.

Edges between the end walls and the side wall may be rounded. The body may be circular in transverse cross section or generally rectangular. In the latter case corner regions of the side wall may also be rounded.

The value of n may be larger than any one of 4, 5, 6, 7, 8, 9 and 10.

The segments may be solid or laminated and arranged linearly.

The segments may have the same length and may be equispaced, so that the widths of the gaps are equal. In other embodiments, at least some of the segments may have different lengths and at least some of the gaps may have different widths.

The primary and secondary windings may be wound concentrically around the core. The secondary winding may be located concentrically closer to the core than the primary winding.

The primary and secondary windings may be wound concentrically around the core from one end of the core to the other. Both of these windings may be wound concentrically around a part of the linearly arranged segments. The windings may be wound linearly along the linear arrangement of segments, so that each winding comprises a plurality of linearly arranged and abutting turns. The primary and secondary windings may overlap with one another or may not overlap.

The transformer may comprise an outer jacket of a magnetic material housing the core, the primary winding and the secondary winding.

The outer jacket may comprise a single elongate hollow cylindrical body.

Alternatively, the outer jacket may comprise a plurality of jacket segments. Each jacket segment may be hollow cylindrical in configuration and the jacket segments may be linearly arranged.

The isolation medium may comprise at least one of a liquid and a solid.

All voids (between windings, between segments, between windings and segments and between windings and the outer jacket) may be filled with the isolation medium.

The invention also includes within its scope a core comprising an elongate limb having a main axis, a plurality (n) of segments of a magnetic material and gaps between segments arranged in alternating relationship along the main axis, each gap having a linear segment separating extent which is parallel to the main axis, n being larger than 3 and the gaps being filled with an isolation medium.

Yet further included within the scope of the present invention is an ignition system for a vehicle comprising a transformer as herein defined and/or described and wherein one end of the secondary winding is connected to at least one spark plug and wherein the transformer is driven resonantly by an oscillating circuit connected to the primary winding.

The oscillating frequency of the oscillating circuit may be between 100 kHz and 3 MHz.

BRIEF DESCRIPTION OF THE ACCOMPANYING DIAGRAMS

Figure 2:
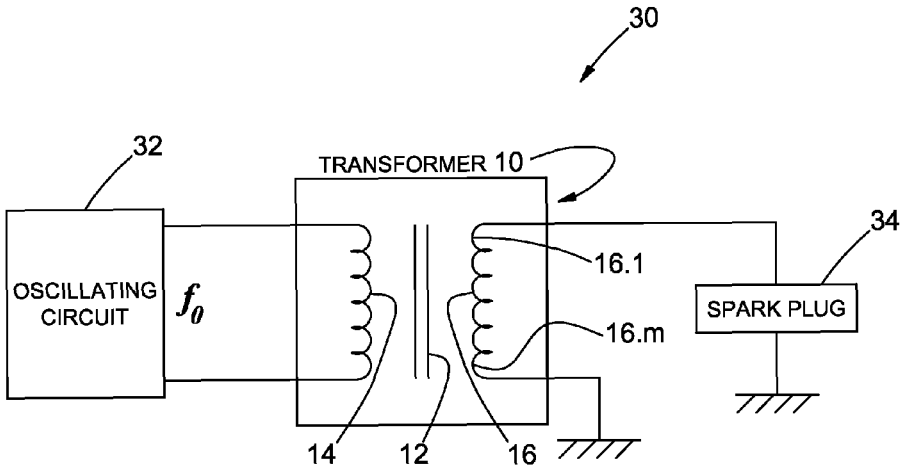

The invention will now further be described, by way of example only, with reference to the accompanying diagrams wherein:

FIG. 1 is a longitudinal section through a transformer according to the invention; and FIG. 2 is a block diagram of relevant parts of an ignition system comprising the transformer.

DESCRIPTION OF A PREFERRED EMBODIMENT OF THE INVENTION

A transformer according to the invention is generally designated by the reference numeral 10 in the figures.

The transformer may find particular application in vehicle ignition systems.

The transformer 10 comprises a core 12, a primary winding 14 and a secondary winding 16. The core comprises an elongate limb 13 having a main axis 15, a plurality (n) of segments (12.1 to **12.*n*) of a magnetic material and gaps (18.1 to 18.*n*–1) between segments arranged in alternating relationship along the main axis 15. The main axis 15 is parallel to a direction of a magnetic field in the limb. Each gap has a linear segment separating extent g which is parallel to the main axis. The value of n is larger than three (3) and the gaps are filled with an isolation medium 20**.

The isolation medium is required to have a large dielectric strength, preferably higher than 9 kV/mm, more preferably higher than 20 kV/mm over the temperature range of −40° C. to +140° C. There are many plastic materials available that meet this requirement. The isolation material must preferably also have a low relative permittivity $\in_r$, typically lower than 4 and preferably lower than 3.

The magnetic material is required to have a high permeability, high saturation flux density and low loss over a −40° C. to +140° C. temperature range and DC to 1 MHz frequency range. An example of such a material is the soft ferrite TSC-50ALL having a relative permeability higher than 3000 for flux densities lower than 3000 Gauss, for frequencies up to 1 MHz and temperatures between −30° C. and +200° C. This ferrite's core loss is less than 10 mW/cm$^3$ at a frequency of 500 kHz, a flux density of 100 Gauss and a temperature of 70° C.

In a preferred embodiment, the segments 12.1 to **12.*n* are arranged linearly and adjacent segments are separated by the gaps 18.1 to 18.*n*–1. The primary winding 14 and the secondary winding 16 are wound concentrically around the core. Each winding comprises a plurality of turns. More particularly secondary winding 16 comprises turns 16.1 to 16.*m*. A concentric outer jacket 22** of a magnetic material provides a magnetic return path. The jacket may comprise a single hollow cylindrical body or may comprise two or more hollow cylindrical segments. The segments may be linearly arranged. The magnetic material of the core segments and the jacket may be the same or may be different materials.

The core has a length l, each segment has a length ls and adjacent segments are separated by a gap extending transversely, typically perpendicularly, relative to the main axis 15. Each gap has a linear segment separating extent or dimension g which is parallel to the main axis 15. The diameter of the core is d. The core 12 and secondary winding 16 are spaced a distance h. This space is also filled by the isolation material 20.

Assume the dielectric material 20 has a dielectric strength of 9 kV/mm with relative permittivity $\in_r$=4, 40 kV between a first turn 16.1 and the last turn **16.*m* of the secondary winding 16 and that a thickness t of the winding is 0.5 mm. A transformer comprising a conventional solid core of length l=55 mm and diameter d=9 mm is compared hereinafter to a comparable transformer 10** according to the invention and as shown in the figures.

For the conventional solid core transformer (not shown) with a distance h between the core and the secondary winding, a minimum isolation thickness of h=2.2 mm is required, assuming that the core is at a voltage of 20 kV when there is a 40 kV difference between the first and last turn of the secondary winding. The isolation annulus has a volume of 4.3 cm$^3$. The capacitance between the secondary winding and the core is 0.56 pF/mm or 31 pF for the whole length l. The capacitance between the first 5 mm of turns and the last 5 mm of turns is given by the capacitance of the first 5 mm of turns and the core in series with the capacitance between the core and the last 5 mm of turns, which is 1.4 pF. The inductance was measured to be about 64nH per turn squared when using TSC-50ALL ferrite. The length of wire per turn is about 40 mm, giving an inductance of 36 pH/mm squared of wire.

For the segmented core 10 according to the invention having ten (10) segments of $l_s$=5 mm long, there is 4 kV between the first and last turns around a segment, when there is a voltage of 40 kV between the first and last turn of the secondary winding. This requires a segment to winding distance h filled by the isolation material 20 of at least 0.44 mm. Assume h=0.5 mm, the volume of the isolation annulus in this case is then 0.8 cm$^3$. The nine (9) gaps 18.1 to 18.9 must withstand 40 kV, which is 4.4 kV per gap, requiring a gap width g=0.5 mm between segments. This corresponds to a volume of 0.3 cm$^3$ between adjacent segments. The capacitance between segments is 4.5 pF and between the winding 16 and a segment 2 pF/mm. The capacitance between the first 5 mm of turns from turn 16.1 and the last 5 mm of turns to turn **16.*m* is 0.45 pF. The inductance was measured to be about 27 nH per turn squared. The length of wire per turn 16.1 to 16.*m*** is 31 mm, giving an inductance of 28 pH/mm squared for a certain length of wire.

Although the inductance is less for a given number of turns (64 nH/mm compared to 27 nH/mm), it is presently believed that more energy can be stored in the magnetic material due to the number of gaps. For the same energy requirements, the segmented core 10 therefore would require a shorter length of winding wire, which would have a lower winding resistance than the corresponding winding of a solid core transformer.

Also, the segmented core need 1.1 cm$^3$ compared to 4.3 cm$^3$ isolation material for the solid core. This is significant when compared to the core's volume of 3.5 cm$^3$. Hence, it is believed that segmentation of the core 12 would reduce the total isolation requirement over the whole length l of the core 12. Turns 16.1 to **16.*m* may be wound closer to the core 12. The resulting smaller radius of the turns reduces the winding wire length and resistance. The shorter segments 12.1 to 12.*n*** may give rise to lower thermal-mechanical stresses, and the distributed gaps between segments may provide higher saturation energy. The capacitance of the secondary winding between the first and last 5 mm of turns is significantly reduced from 1.4 pF to 0.45 pF.

The transformer may find particular application in an ignition system 30 (shown in FIG. 2) for a vehicle (not shown). The transformer may be driven resonantly, similarly to a Tesla coil, by an oscillating circuit 32 at an oscillating frequency $f_o$ of about 100 kHz-3 MHz, where energy is transferred from the primary winding 14 to the secondary winding 16 during each cycle of several cycles. It is expected that the requirement for good coupling between the primary winding 14 and secondary winding 16 would not be as strict as with a conventional transformer comprising a conventional unitary core.

Turn 16.1 is normally connected to a spark plug 34 and turn 16.*m* may be grounded or connected to an energy (voltage or current) source. The magnetic core 12 may be designed to saturate when energy is transferred directly through the secondary winding 16 for fast energy transfer.

The invention claimed is:

1. A transformer comprising a core, a primary winding and a secondary winding, the core comprising an elongate limb having a main axis, a plurality (n) of segments of a magnetic material and gaps between segments arranged in alternating relationship along the main axis, each gap having a linear segment separating extent which is parallel to the main axis, n being larger than 3, and the gaps between the segments and a gap between the core and the secondary winding being filled with an isolation medium having a dielectric strength of higher than 9 kV/mm.

2. A transformer as claimed in claim 1 wherein the secondary winding is wound from one end of the core to another end of the core.

3. A transformer as claimed in claim 1 wherein the isolation medium has a dielectric strength of higher than 20 kV/mm.

4. A transformer as claimed in claim 1 wherein n is larger than any one of 4, 5, 6, 7, 8, 9 and 10.

5. A transformer as claimed in claim 1 wherein the segments are solid, wherein the main axis is linear and wherein the primary and secondary windings are wound concentrically around the core.

6. A transformer as claimed in claim 1 wherein at least some of the segments are laminated, wherein the main axis is linear and wherein the primary and secondary windings are wound concentrically around the core.

7. A transformer as claimed in claim 5 wherein each of the primary and secondary windings are wound linearly around the core so that each winding comprises a plurality of linearly arranged and abutting turns.

8. A transformer as claimed in claim 5 wherein the secondary winding is located concentrically closer to the core than the primary winding.

9. A transformer as claimed in claim 1 comprising an outer jacket of a magnetic material housing the core, the primary winding and the secondary winding and providing a magnetic return path.

10. A transformer as claimed in claim 9 wherein the outer jacket comprises a single elongate hollow cylindrical body.

11. A transformer as claimed in claim 9 wherein the outer jacket comprises a plurality of jacket segments.

12. A transformer as claimed in claim 11 wherein each jacket segment is hollow cylindrical in configuration and wherein the jacket segments are linearly arranged.

13. A transformer as claimed in claim 1 wherein the isolation medium comprises at least one of a liquid and a solid.

14. A transformer as claimed in claim 9 wherein voids within the outer jacket are filled by the isolation medium comprising at least one of a liquid and a solid.

15. An ignition system for a vehicle comprising a transformer as claimed in claim 1, wherein one end of the secondary winding is connected to at least one spark plug and wherein the transformer is driven resonantly by an oscillating circuit connected to the primary winding.

16. An ignition system as claimed in claim 15 wherein an oscillating frequency of the oscillating circuit is between 100 kHz and 3 MHz.

* * * * *